US005824208A

United States Patent [19]

Bienstock et al.

[11] Patent Number: 5,824,208

[45] Date of Patent: Oct. 20, 1998

[54] SHORT CONTACT TIME CATALYTIC CRACKING PROCESS

[75] Inventors: Martin G. Bienstock, Succasunna; Paul K. Ladwig, Randolph, both of N.J.

[73] Assignee: Exxon Research & Engineering Company, Florham Park, N.J.

[21] Appl. No.: 508,774

[22] Filed: Jul. 28, 1995

Related U.S. Application Data

[63] Continuation of Ser. No. 250,257, May 27, 1994, abandoned.

[51] Int. Cl.[6] ..... C10G 51/02

[52] U.S. Cl. ..... 2108/76; 208/74; 208/120

[58] Field of Search ..... 208/72, 73, 74, 208/76, 112, 120

[56] References Cited

U.S. PATENT DOCUMENTS

| | | | |
|---|---|---|---|
| 2,431,243 | 11/1947 | Greensfelder et al. | 196/52 |
| 2,956,003 | 10/1960 | Marshall et al. | 208/74 |
| 3,433,733 | 3/1969 | Bunn et al. | 208/150 |
| 3,784,463 | 1/1974 | Reynolds et al. | 208/74 |
| 3,886,060 | 5/1975 | Owen | 208/120 |
| 3,894,931 | 7/1975 | Nace et al. | 208/73 |
| 3,894,933 | 7/1975 | Owen et al. | 208/77 |
| 3,894,934 | 7/1975 | Owen et al. | 208/78 |
| 3,896,024 | 7/1975 | Nace | 208/74 |
| 4,310,489 | 1/1982 | Fahrig et al. | 422/110 |
| 4,388,175 | 6/1983 | Lionetti et al. | 208/77 |
| 4,428,822 | 1/1984 | Jones | 208/76 |
| 4,606,810 | 8/1986 | Krambeck et al. | 208/76 |
| 4,749,470 | 6/1988 | Herbst et al. | 208/85 |
| 5,009,769 | 4/1991 | Goelzer | 208/113 |

*Primary Examiner*—Glenn Caldalola
*Assistant Examiner*—Bekir L. Yildirim
*Attorney, Agent, or Firm*—Roy J. Ott

[57] ABSTRACT

Disclosed is a catalytic cracking process which incorporates a short contact time catalytic cracking step. The short contact time cracking step provides for an overall increase in distillate quality as well as provides for an overall increase in the quantity of light olefins product. After the short contact time reaction step, gasoline and high quality distillate products are separated from a gas oil containing bottoms fraction, and the gas oil containing bottoms fraction is reprocessed.

10 Claims, 1 Drawing Sheet

SHORT CONTACT TIME CATALYTIC CRACKING PROCESS

This is a continuation, of application Ser. No. 08/250,257, filed May 27, 1994, abandoned.

FIELD OF THE INVENTION

This invention relates to a catalytic cracking process which includes a short contact time catalytic cracking step. In particular, the invention relates to a catalytic cracking process in which a hydrocarbon is initially contacted with cracking catalyst forming a first cracked hydrocarbon product in which less than 50 wt % of the first cracked hydrocarbon product has a boiling point of less than or equal to 430° F. A gas oil fraction is then recovered from the first cracked product, and the gas oil fraction is reprocessed by contacting with a cracking catalyst forming a second cracked product.

BACKGROUND OF THE INVENTION

Short contact time catalytic cracking reaction systems have recently evolved to replace the longer residence time riser and dilute phase reactor systems in use today in order to maximize olefins yields and to reduce coke and dry gas production. Residence times (i.e., the time in which hydrocarbon feed is in contact with the cracking catalyst) in the longer residence time systems are typically from 15 to 30 seconds, whereas the short contact time commercial systems are typically in the range of 2 to 5 seconds.

U.S. Pat. No. 4,749,470 discloses a fluid catalytic cracking unit which initially cracks residuum feed in a first riser reactor. The feed is contacted with the cracking catalyst in the first riser for less than one second. According to the patent, quick cracking in the first riser is accomplished due to activation of the feed by microwave energy. A gas oil product from the initial cracking reaction step in the first riser is then sent to a second riser reactor where the reaction temperature is maintained within the same range as the first riser.

Rehbein et al., Paper 8 from *Fifth World Petroleum Progress*, Jun. 1–5, 1959, Fifth World Petroleum Congress, Inc., New York, pages 103–122 (which corresponds to U.S. Pat. No. 2,956,003, Marshall et al.), disclose a two stage catalytic cracking process which uses a short contact time riser as the first stage. The first stage is described as being designed to give 40–50 wt % conversion. The second stage is a dense bed system that is stated as being designed to charge gas oils from the first stage along with a recycle stream to give overall conversions of 63–72 wt %, although the unit is said to have been run at low enough charge rates to achieve total conversions from 65–90 wt %.

As the prior art demonstrates, in order to maintain a desirably high conversion of feed to products in the short contact time systems, reactor temperature, catalyst activity, or catalyst circulation rate, or some combination thereof is increased throughout the entire system. A problem with an overall system increase of any one of these parameters is that there is a high probability that undesirable side reactions will occur. These undesirable side reactions result in increased hydrogen transfer rates which cause light olefins saturation and aromatics formation. Thus, while conventional short contact time catalytic cracking processes provide some marginal improvement in olefins yield, current designs are particularly limited in their potential to enhance distillate quality due to the inherent nature of the reaction chemistry. It is, therefore, desirable to obtain a catalytic cracking process which maximizes olefins production while minimizes aromatics formation.

SUMMARY OF THE INVENTION

In order to overcome problems inherent in the prior art, the present invention provides a catalytic cracking process which comprises the steps of (a) contacting a hydrocarbon with cracking catalyst under catalytic cracking conditions forming a first cracked hydrocarbon product in which less than 50 wt % of the first cracked hydrocarbon product has a boiling point of less than or equal to 430° F.; (b) separating from the first cracked hydrocarbon product a gas oil containing bottoms fraction having an initial boiling point of at least 550° F.; and (c) contacting the gas oil containing bottoms fraction with cracking catalyst, under catalytic cracking conditions which include a reaction temperature that is at least equal to that used under the catalytic cracking conditions of step (a), forming a second cracked hydrocarbon product in which at least 65 wt % of the combined first and second cracked hydrocarbon products have a boiling point of less than or equal to 430° F.

In a preferred embodiment, the hydrocarbon is contacted with the cracking catalyst at a temperature of 950°–1100° F. It is further preferred that the hydrocarbon is contacted with a zeolite cracking catalyst for less than five seconds. More preferably, the hydrocarbon is contacted with the zeolite catalyst for 1–2 seconds.

In another preferred embodiment, the first cracked hydrocarbon product is collected in a vessel separate from the second cracked hydrocarbon product. It is further preferred that the gas oil containing bottoms fraction and the cracking catalyst are contacted at a temperature of 950°–1200° F.

In yet another preferred embodiment the gas oil containing bottoms fraction and the cracking catalyst are contacted at a temperature which is up to 100° F. higher than that used in step (a). Further, it is preferred that the second cracked hydrocarbon product is separated into component fuel products in a product fractionation system that is separate from that used to separate the gas oil containing bottoms fraction from the first cracked hydrocarbon product. More particularly, it is preferred that a first cyclone system is used to separate the gas oil containing bottoms fraction from the first cracked hydrocarbon product and a second cyclone system is used to separate the second hydrocarbon product into component fuel products. In addition, it is preferable that a 430°–630° F. distillate fraction is separated from the first cracked hydrocarbon product and recovered.

BRIEF DESCRIPTION OF THE DRAWING

The present invention will be better understood by reference to the Detailed Description of the Invention when taken together with the attached drawing, wherein.

DETAILED DESCRIPTION OF THE INVENTION

Figure 1:
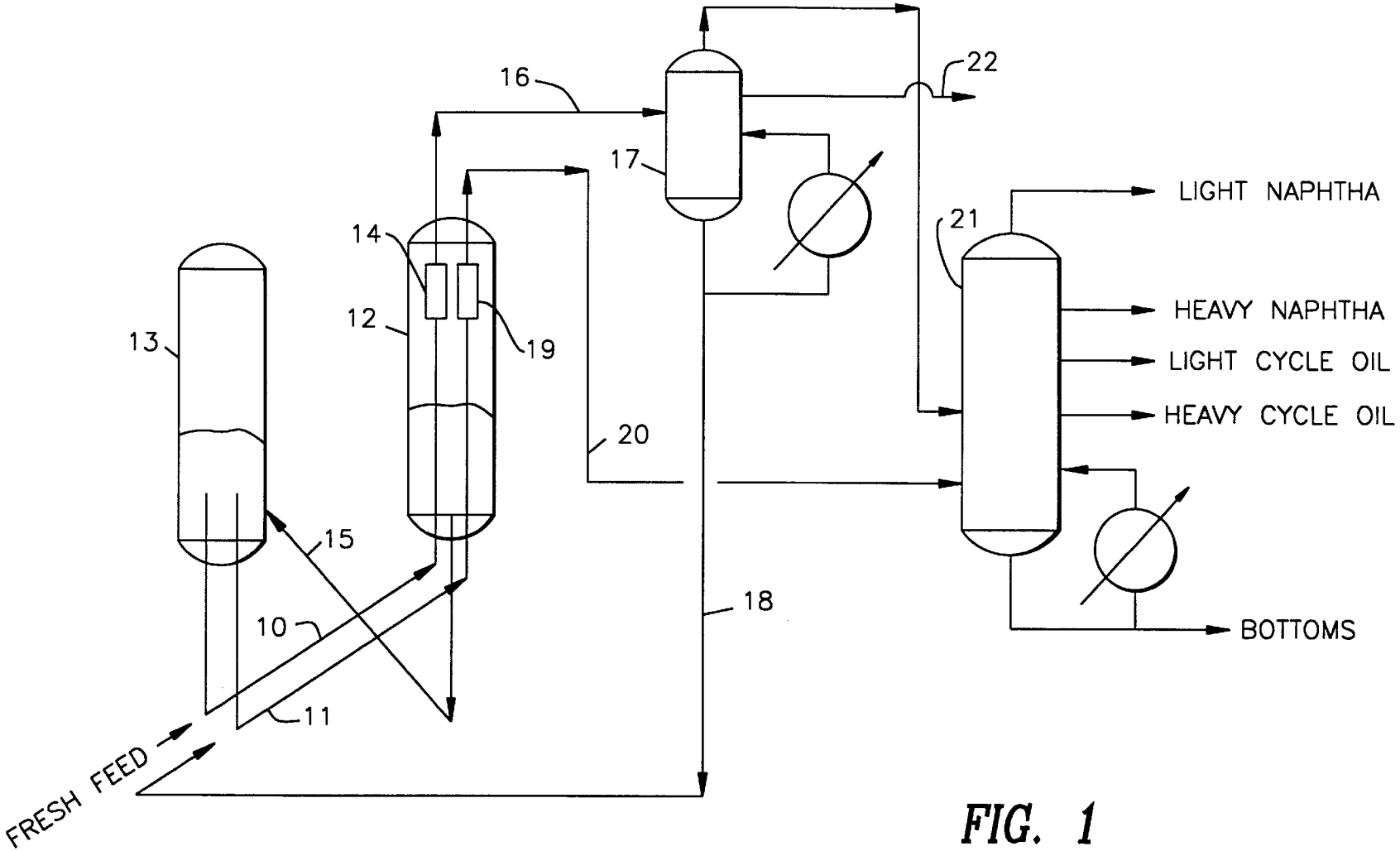
FIG. 1 is a schematic representation of a preferred embodiment of the invention.

Catalytic cracking is a process which is well known in the art of petroleum refining and generally refers to converting at least one large hydrocarbon molecule to smaller hydrocarbon molecules by breaking at least one carbon to carbon bond. For example, a large paraffin molecule can be cracked into a smaller paraffin and an olefin, and a large olefin molecule can be cracked into two or more smaller olefin molecules. The cracking reaction can also involve the opening of at least one naphtheno ring of a multi-ring compound, as well as the cracking of long side chain molecules which may be present on single or multi-ring aromatic compounds.

It has been found that the quantity of light olefins product and the quality of distillate product that is formed during the catalytic cracking process can be improved by initially incorporating a short contact time reaction step into the overall catalytic cracking process. After the short contact time reaction step, a gas oil containing bottoms fraction is separated from the product portion, and the gas oil containing bottoms fraction is reprocessed at a higher intensity relative to that used in the initial short contact time reaction step.

In the catalytic cracking process of this invention, the hydrocarbon feed is preferably a petroleum hydrocarbon. The petroleum hydrocarbon is preferably a distillate fraction having an initial ASTM boiling point of at least about 400° F., more preferably at least about 600° F. Such hydrocarbon fractions include gas oils, thermal oils, residual oils, cycle stocks, topped and whole crudes, tar sand oils, shale oils, synthetic fuels, heavy hydrocarbon fractions derived from the destructive hydrogenation of coal, tar, pitches, asphalts, and hydrotreated feed stocks derived from any of the foregoing.

The hydrocarbon feed is preferably introduced into a riser which connects to a catalytic cracking reactor vessel. Preferably, the feed is mixed in the riser with catalytic cracking catalyst that is continuously recycled.

The hydrocarbon feed can be mixed with steam or an inert type of gas at such conditions so as to form a highly atomized stream of a vaporous hydrocarbon-catalyst suspension. Preferably, this suspension flows through the riser and into a vapor and catalyst separation device.

In the short contact time reaction step of this invention, it is preferable that the hydrocarbon feed contacts the cracking catalyst under catalytic cracking conditions to form a first cracked hydrocarbon product, and the catalytic cracking conditions are controlled so that less than 50 wt % of the first cracked hydrocarbon product has a boiling point below about 430° F. More preferably, catalytic cracking conditions are controlled so that 25–40 wt % of the first cracked hydrocarbon product has a boiling point equal to or below about 430° F.

The 430° F. boiling point limitation is not per se critical, but is used to give a general indication of the amount of gasoline and high quality distillate type products that are formed in the short contact time reaction step. In the short contact time reaction step, therefore, it is desirable to initially limit the conversion to gasoline and high quality distillate type products. By controlling the conversion in this step, hydrogen transfer can be favorably affected, i.e., minimized.

According to this invention, short contact time means that the hydrocarbon feed will contact the cracking catalyst for less than five seconds. In typical fluid catalytic cracking systems this means that the vapor residence time will be less than five seconds. Preferably, in the initial short contact time reaction step, the hydrocarbon feed will contact the cracking catalyst for 1–4 seconds.

The short contact time reaction step can be achieved using any of the known processes. For example, in one embodiment a close coupled cyclone system effectively separates the catalyst from the reacted hydrocarbon to quench the cracking reaction. See, for example, Exxon's U.S. Pat. No. 5,190,650, of which the detailed description is incorporated herein by reference.

Short contact time can be achieved in another embodiment by injecting a quench fluid directly into the riser portion of the reactor. The quench fluid is injected into the appropriate location to quench the cracking reaction in less than one second. See, for example, U.S. Pat. No. 4,818,372, of which the detailed description is incorporated herein by reference. Preferred as a quench fluid are such examples as water or steam or any hydrocarbon that is vaporizable under conditions of injection, and more particularly the gas oils from coking or visbreaking, catalytic cycle oils, and heavy aromatic solvents as well as certain deasphalted fractions extracted with a heavy solvent.

In yet another embodiment, short contact time can be achieved using a downflow reactor system. In downflow reactor systems, contact time between catalyst and hydrocarbon can be as low as in the millisecond range. See, for example, U.S. Pat. Nos. 4,985,136, 4,184,067 and 4,695,370. of which the detailed descriptions of each are incorporated herein by reference.

The particular catalytic cracking conditions used to achieve conversion to a product in which less than 50 wt % of the product has a boiling point less than 430° F. are readily obtainable by those of ordinary skill in the art. Once the preferred particular cracking catalyst is chosen, the operations parameters of pressure, temperature and vapor residence time are optimized according to particular unit operations constraints. For example, if it is desired to use a zeolite type of cracking catalyst, the short contact time reaction step will typically be carried out at a pressure of 0–100 psig (more preferably 5–50 psig), a temperature of 900°–1150° F. (more preferably 950°–1100° F.) and a vapor residence time of less than five seconds (more preferably 2–5 seconds).

Regardless of the type of quenching step used to achieve the short contact time reaction, the catalyst is separated from the vapor to obtain the desired products according to the known processes, such as by using cyclone separators. The separated vapor comprises the cracked hydrocarbon product, and the separated catalyst contains a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst under standard regeneration conditions. Preferably, the coke is combusted at a temperature of about 900°–1400° F. and a pressure of about 0–100 psig. After the combustion step, the regenerated catalyst is recycled to the riser for contact with additional hydrocarbon feed. Preferably, the regenerated catalyst contains less than 0.4 wt % coke, more preferably less than 0.1 wt % coke.

The catalyst which is used in this invention can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluninophophates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, ofretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM # D3907-8). Compounds such as those disclosed in Greensfelder, B. S., et al., *Industrial and Engineering Chemistry*, pp. 2573–83, November, 1949, are desirable. Alumina, silica-alumina and silica-alumina-zirconia compounds are preferred.

The inert catalyst framework component densities, strengthens and acts as a protective thermal sink. The inert catalyst framework component used in this invention preferably has a cracking activity that is not significantly greater than the acceptable thermal blank. Kaolin and other clays as well as a-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as a-alumina, b-alumina, g-alumina, d-alumina, e-alumina, k-alumina, and r-alumina can be employed. Preferably, the alumina species is an aluminum trihydroxide such as gibbsite, bayerite, nordstrandite, or doyelite.

The products recovered from the initial short contact time reaction step are preferably separated so that a gas oil containing bottoms fraction is recovered for reprocessing. Preferably, the gas oil containing bottoms fraction contains a distillate having an initial boiling point (i.e., ASTM initial boiling point) of at least 550° F., more preferably an initial boiling point of at least 600° F.

After the gas oil containing bottoms fraction is separated, it is contacted in at least one subsequent cracking step with a cracking catalyst under catalytic cracking conditions which favor cracking of the heavier hydrocarbons contained in the bottoms fraction. It is preferred in any subsequent cracking step that the reaction time be longer and the reaction temperature be at least equal to that used in the short contact time reaction step. The appropriate catalytic cracking conditions employed following the short contact time reaction step will be controlled so that the combined products of all of the cracking steps will yield an overall product in which at least 65 wt % of the overall product has a boiling point of less than or equal to about 430° F.

In any cracking steps following the short contact time reaction step, the conditions which are used to achieve the desired overall product boiling point characteristics are readily obtainable by those of ordinary skill in the art and are optimized according to the needs of the specific operating unit. Since the same catalyst is generally used in the short contact time reaction step as in a subsequent cracking reaction step, it is preferred to increase slightly the severity of the reaction conditions in the subsequent reaction step. Preferably, this is done by increasing the vapor contact time in the subsequent reaction step, while maintaining reaction temperatures and pressures similar to that in the short contact time step. For example, when using a zeolite type of cracking catalyst, it is preferred to have a vapor residence time of less than 10 seconds, more preferably a vapor residence time of 2–8 seconds.

Depending upon the quality of the feed and the particular reaction equipment used, however, it can be desirable to increase the temperature of the subsequent reaction step. Preferably, any temperature increase will be less than about 100° F. higher than in the short contact time reaction step and in a range of about 950°–1200° F.

Pressure and catalyst to oil ratio in any subsequent cracking reaction step will typically be about the same as in the short contact time reaction step. Variations in both pressure and catalyst to oil ratio can occur, however, due to physical constraints within the reaction system. For example, the location of cyclones used to separate cracked hydrocarbon product and the types of feed injection systems used can have a different effect on the operation of each reaction step.

A preferred embodiment of the invention is shown in FIG. 1 in which the cracking reaction is carried out using dual risers 10, 11 and a main vessel 12, with the spent catalyst being regenerated in a regenerator 13. Although a dual riser design is shown as one preferred embodiment, the process of this invention can be carried out using more than one main vessel or regenerator with a single riser feeding each main vessel.

In FIG. 1, fresh hydrocarbon feed is injected into the riser 10 where it contacts hot catalyst from the regenerator 13 to begin the cracking reaction. The reaction products and catalyst are then separated using a cyclone separator 14. The spent catalyst falls through a stripper and standpipe and is carried through a riser 15 to the regenerator 13 where it is regenerated for further use.

Cracked hydrocarbon product is removed from the cyclone 14 by way of a line 16 which leads to a separation vessel 17. The separation vessel 17 is used to separate a relatively heavy gas oil containing bottoms fraction from a lighter gasoline and high quality distillate fraction. As stated above, operating conditions with the riser 10 are maintained such that less than 50 wt % of the cracked hydrocarbon product collected in the separation vessel 17 has a boiling point of less than or equal to 430° F.

The gas oil containing bottoms fraction is removed from the separation vessel 17 by way of a line 18 which is used to inject the bottoms fraction into the riser 11, where it contacts hot regenerated catalyst from the regenerator 13. Cracked products from the riser 11 are separated from the spent catalyst using a cyclone separator 19. The spent catalyst is combined with the spent catalyst that is separated using the cyclone separator 14, and is sent through the riser 15 to the regenerator 13 where it is regenerated for further use.

Cracked hydrocarbon product is removed from the cyclone separator 19 by way of a line 20 which leads to a separation vessel 21. As described above, operating conditions within the riser 11 are maintained such that at least 65 wt % of the overall product collected in both separation vessels 17 and 21 has a boiling point of less than or equal to 430° F. It is preferable to use two different separation vessels to separately collect the product stream from each stage. A 430°–630° F. distillate fraction is preferably withdrawn as side stream 22 from separation vessel 17 to segregate this high quality product from the fist stage. As shown in FIG. 1, separation vessel 21 serves as a product fractionation system which is used to separate the total second cracked product from cyclone separator 19 along with the light cracked products from the cyclone separator 14 into component fuel products, such as a light naphtha stream, a heavy naphtha stream, a light cycle oil, a heavy cycle oil, and a bottoms fraction.

The invention will be further understood by reference to the following Example, which includes a preferred embodiment of the invention.

EXAMPLE

Comparative catalytic cracking reactions were run using two different reaction vessels. One reaction vessel was a typical single riser reactor (i.e., Exxon Model IV), and the other reaction vessel incorporated dual riser reactors as shown in FIG. 1. The first reaction vessel served as the base case and was operated under standard catalytic cracking conditions (temperature of 1040° F., catalyst/oil ratio of 7, total reactor residence time of 15 seconds). One of the dual risers in the second reaction vessel was used to perform the short contact time step of the invention (i.e., stage 1: temperature of 1000° F., catalyst/oil ratio of 6, total reactor residence time of less than 1 second). The other of the dual risers was used to perform the reprocessing step (i.e., stage 2: temperature of 1040° F., catalyst/oil ratio of 9, total reactor residence time of about 5 seconds). The comparative results are shown in Tables 1 and 2.

TABLE 1

| | Yield, wt % | | | | |
|---|---|---|---|---|---|
| | Base | Stage 1 | Stage 2 Marg. Yld. | Stage 2 Total Yld. | Combined |
| C2– | 5.0 | 2.5 | 1.2 | 3.3 | 3.7 |
| C3 + C4 | 18.0 | 9.0 | 7.0 | 19.1 | 16.0 |
| C3= | 5.1 | 3.0 | 2.0 | | 5.0 |
| C3 | 1.9 | 0.6 | 0.6 | | 1.2 |
| C4= | 6.9 | 4.0 | 3.0 | | 7.0 |
| C4 | 4.1 | 1.4 | 1.4 | | 2.8 |
| % C3= in C3s | 72.5 | 82.0 | 76.9 | | 79.3 |
| % C4= in C4s | 63.0 | 75.0 | 68.2 | | 69.7 |
| % C3 in LPG | 38.9 | 40.0 | 37.3 | | 38.8 |
| C5/430 | 44.5 | 30.0 | 16.9 | 46.2 | 46.9 |
| 430/650 | 17.0 | 18.0 | 3.3 | 9.0 | 21.3 |

TABLE 1-continued

| | Yield, wt % | | | | |
|---|---|---|---|---|---|
| | Base | Stage 1 | Stage 2 Marg. Yld. | Stage 2 Total Yld. | Combined |
| 650+ | 9.5 | 36.5 | 5.3 | 14.6 | 5.3 |
| Coke | 6.0 | 4.0 | 2.7 | 7.4 | 6.7 |
| 430 Conv., wt % | 73.5 | 45.5 | | 76.4 | 73.4 |

TABLE 2

| | Product Quality | | | | |
|---|---|---|---|---|---|
| | Base | Stage 1 | Stage 2 Marg. Yld. | Stage 2 Total Yld. | Combined |
| C5/430 | | | | | |
| API | 49.8 | 51.4 | 49.8 | | 50.8 |
| RONC | 95.0 | 94.0 | 95.0 | | 94.3 |
| MONC | 82.5 | 80.5 | 82.5 | | 81.2 |
| % Aromatics | 47.0 | 34.0 | 37.0 | | 39.0 |
| 430/650 | | | | | |
| API | 15.4 | 26.0 | 13.0 | | 23.9 |
| % Aromatics | 85.0 | 50.0 | 90.0 | | 56.0 |
| Est. Cetane (1980) | 14.0 | | | | 28.0 |
| 650+ | | | | | |
| API | −2.8 | 15.6 | −5.0 | | −5.0 |

Having now fully described this invention, it will be appreciated by those skilled in the art that the invention can be performed within a wide range of parameters within what is claimed.

What is claimed is:

1. A catalytic cracking process for maximizing olefin yield and minimizing distillate aromatic yield, which process comprises:

(a) contacting a hydrocarbon feed with regenerated cracking catalyst under catalytic cracking conditions including a contact time of less than five seconds to form a first cracked hydrocarbon product in which less than 50 wt % of the first cracked hydrocarbon product has a boiling point of less than or equal to 430° F.;

(b) separating from the first cracked hydrocarbon product a gas oil containing bottoms fraction having an initial boiling point of at least 550° F.; and (c) contacting the gas oil containing bottoms fractions from step (b) and regenerated cracking catalyst without the present of an additional hydrocarbon feedstock under catalytic cracking conditions which include a reaction temperature that is greater than that used under the catalytic cracking conditions of step (a) and a contact time greater than the contact time of step (a) to form a second cracked hydrocarbon product; and (d) recovering from the first cracked hydrocarbon product and the second cracked hydrocarbon product a recovered hydrocarbon product having a boiling point no greater than 430° F., said recovered hydrocarbon product accounting for more than 65 wt % of the total of the first cracked hydrocarbon product and the second cracked hydrocarbon product.

2. The catalytic cracking process of claim 1, wherein the hydrocarbon in step (a) is contacted with the cracking catalyst at a temperature of 950°–1100° F.

3. The catalytic cracking process of claim 1, wherein the hydrocarbon in step (a) is contacted with a zeolite catalyst.

4. The catalytic cracking process of claim 3, wherein the hydrocarbon in step (a) is contacted with the zeolite catalyst for 1–2 seconds.

5. The catalytic cracking process of claim 1, wherein the first cracked hydrocarbon product is collected in vessel separate from the second cracked hydrocarbon product.

6. The catalytic cracking process of claim 1, wherein the gas oil containing bottoms fraction and the cracking catalyst in step (c) are contacted at a temperature of 950°–1200° F.

7. The catalytic cracking process of claim 1, wherein the gas oil containing bottoms fraction and the cracking catalyst in step (c) are contacted at a temperature which is up to 100° F. higher than that used in step (a).

8. The catalytic cracking process of claim 1, wherein the second cracked hydrocarbon product is separated into component fuel products in a product fractionation system that is separate from that used to separate the gas oil containing bottoms fraction from the first cracked hydrocarbon product.

9. The catalytic cracking process of claim 8, wherein a first cyclone system is used to separate the gas oil containing bottoms fraction from the first cracked hydrocarbon product and a second cyclone system is used to separate the second hydrocarbon product into component fuel products.

10. The catalytic cracking process of claim 1, wherein a 430°–630° F. distillate fraction is separated from the first cracked hydrocarbon product and recovered.

* * * * *